US005847635A

United States Patent [19]

Kudo

[11] Patent Number: 5,847,635

[45] Date of Patent: Dec. 8, 1998

[54] BLADE-TYPE FUSE ELEMENT HAVING A LOAD PORTION

[75] Inventor: Toshiharu Kudo, Shizuoka, Japan

[73] Assignee: Yazaki Corporation, Tokyo, Japan

[21] Appl. No.: 733,876

[22] Filed: Oct. 18, 1996

[30] Foreign Application Priority Data

Oct. 20, 1995 [JP] Japan ..... 7-272991

[51] Int. Cl.[6] ..... H01H 85/08

[52] U.S. Cl. ..... 337/198; 337/290; 337/295; 337/416

[58] Field of Search ..... 337/142, 158, 337/159, 160, 186, 198, 216, 227, 290, 292, 295, 296, 401, 403, 405, 413, 416

[56] References Cited

U.S. PATENT DOCUMENTS 1,774,252 8/1930 Bussmann ..... 337/295 X
2,004,191 6/1935 Bussmann ..... 337/295 X
3,909,767 9/1975 Williamson et al. ..... 337/265
5,293,147 3/1994 Oh et al. ..... 337/227

FOREIGN PATENT DOCUMENTS 59-16054 7/1982 Japan .

*Primary Examiner*—Leo P. Picard
*Assistant Examiner*—Jayprakash N. Gandhi
*Attorney, Agent, or Firm*—Sughrue, Mion, Zinn, Macpeak & Seas, PLLC

[57] ABSTRACT

A fuse element which has an enhanced durability against a rush current, and is suppressed in temperature rise. The fuse element includes a pair of terminals, a fusible element interconnecting the pair of terminals, and at least one load portion is formed on the fusible element. The fusible element and the load portion are made of the same material.

9 Claims, 4 Drawing Sheets

BLADE-TYPE FUSE ELEMENT HAVING A LOAD PORTION

BACKGROUND OF THE INVENTION

1. Field of the Invention

This invention relates to a fuse element which exhibits high durability in a small-current range and a large-current range.

2. Background

There are known a fusible link-type fuse and a blade-type fuse which protect a circuit from excess current. The fusible link-type fuse is excellent in melting-severing characteristics, but has a large size, and therefore such fusible link-type fuses can not be suitably mounted at a high density, for example, in a fuse box in an automobile. On the other hand, the blade-type fuse has a small size, and therefore they can be suitably mounted at a high density.

FIG. 6 shows a blade-type fuse. As shown in FIG. 6, an element 3 is formed between a pair of terminals 1 and 2 integrally therewith by cutting, pressing or any other suitable devices. Retaining holes 1*a* and 2*a* are formed respectively through generally central portions of the terminals 1 and 2, and when this fuse element is attached to a housing 4 molded of a transparent resin, retaining projections 5 and 6, formed on the housing 4, are engaged in the retaining holes 1*a* and 2*a*, respectively.

The fuse of the above construction is mounted, for example, in a fuse box in an automobile, and when excess current is produced, the element 3 melts to be severed, thereby isolating a circuit from a power source, so that a wire, installed in the automobile, is prevented from damage due to the excess current.

The above blade-type fuse is smaller in size than the fusible link-type fuse, but has a problem that the former is inferior in melting-severing characteristics to the latter.

To facilitate a small-size design of the blade-type fuse, zinc or a zinc alloy, having excellent shaping properties, is used. However, zinc or a zinc alloy has a relatively high resistance, and therefore has a characteristic that its temperature rapidly rises upon application of excess current. Therefore, the fuse element has quick-acting melting-severing characteristics, so that the durability is lowered.

SUMMARY OF THE INVENTION

With the above problems in view, it is an object of this invention to provide a fuse element which has an enhanced durability against a rush current, and is suppressed in temperature rise.

The above object of the invention has been achieved by a fuse element including a pair of terminals, a fusible element interconnecting the pair of terminals, and at least one load portion is formed on the fusible element, the fusible element and the load portion being made of the same material.

The load portion is defined by a thickened portion formed integrally with the fusible element, and a thickness of the thickened portion is larger than a thickness of the fusible element, and is equal to or smaller than a thickness of the terminals.

In the above construction, the load portion, formed on the fusible element, has the function of reducing a fuse resistance and also the function of applying a load to the fusible element. Because of the reduced fuse resistance, the melting-severing time is increased or prolonged, and because of the application of the load to the fusible element, the severing of the fusible element by melting is promoted.

The fuse element has slow-acting melting-severing characteristics in a small-current range, and has quick-acting melting-severing characteristics in a large-current range. The function of the load portion to apply a load to the fusible element is almost ignored in the large-current range in which the quick-acting melting-severing characteristics are exhibited. The reason for this is that the fusible element is severed instantaneously in the large-current range, so that the time period of application of the load to the fusible element is short.

On the other hand, in a small-current range, the slow-acting melting-severing characteristics are exhibited, and therefore the time period of application of the load to the fusible element is long. Therefore, in the small-current range, the fuse resistance is low, and the heating of the fusible element is suppressed, and therefore the melting-severing time is increased; however, the severing of the fusible element by melting is promoted by application of the load to the fusible element. As a result, the melting-severing characteristics are generally the same as obtained where the load portion is not provided.

DETAILED DESCRIPTION OF THE PREFERRED EMBODIMENTS

A preliminary embodiment for the present invention will now be described with reference to FIG. 7.

Figure 7:
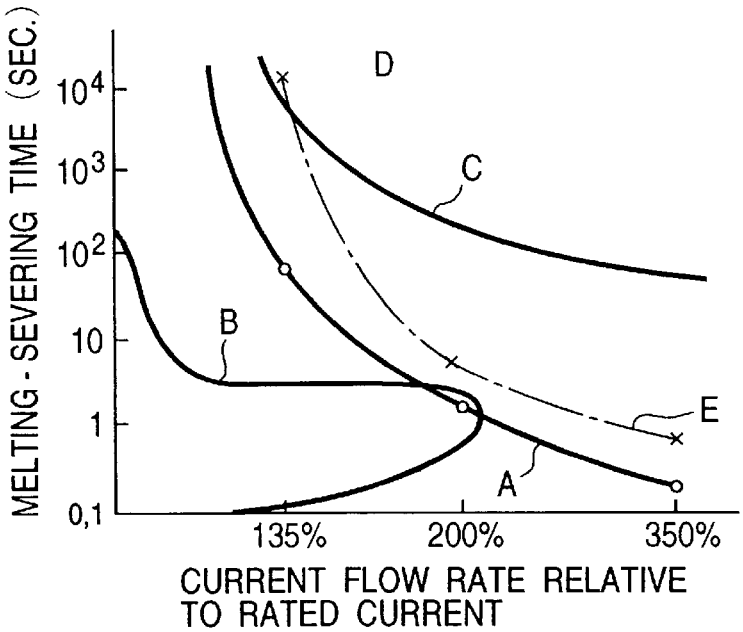
FIG. 7 is a characteristics graph showing the relation between a current flow rate relative to a rated current of a first reference fuse,element of the conventional construction and a melting-severing time, and the relation between a current flow rate relative to a rated current of a second reference fuse element of a low-resistance and a melting-severing time.
Figure 6:
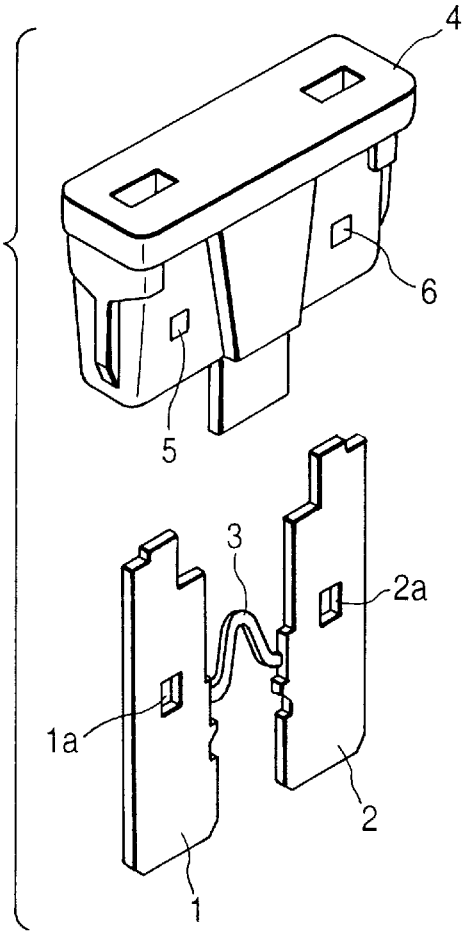
FIG. 6 PRIOR ART
FIG. 6 is an exploded, perspective view of a conventional fuse element.

FIG. 7 shows the relation between a current flow rate relative to a rated current and a melting-severing time. In FIG. 7, reference character A denotes characteristics of a first reference blade-type fuse of the conventional construction, reference character B denotes rush current characteristics, and reference character C denotes wire smoke characteristics. As shown in FIG. 7, the blade-type fuse has slow-acting melting-severing characteristics in a small-current range represented by the current flow rate of about 135%, and therefore its characteristic curve does not overlap the range of the rush current B.

However, in a large-current range represented by the current flow rate of about 200% , the melting-severing characteristics exhibit quick-acting characteristics, and the characteristic curve overlaps the range of the rush current B. Thus, it will be appreciated that the fuse has a low durability against the rush current particularly in the large-current range.

In order to enhance the durability against the rush current in the large-current range, it was proposed to lower a resistance of the fuse element, thereby suppressing its temperature rise.

In FIG. 7, reference character E denotes characteristics of a second reference fuse element formed of a low-resistance material. As shown in FIG. 7, when the fuse element thus has a low resistance, its characteristic curve is out of the range of the rush current B.

However, the melting-severing time is increased as a whole, and therefore particularly in the small-current range represented by the current flow rate of about 135% , the characteristic curve overlaps a dangerous region D of the wire smoke characteristics C.

In view of the above, a preferred embodiment of the present invention will now be described with reference to FIGS. 1–4.

Figure 1:
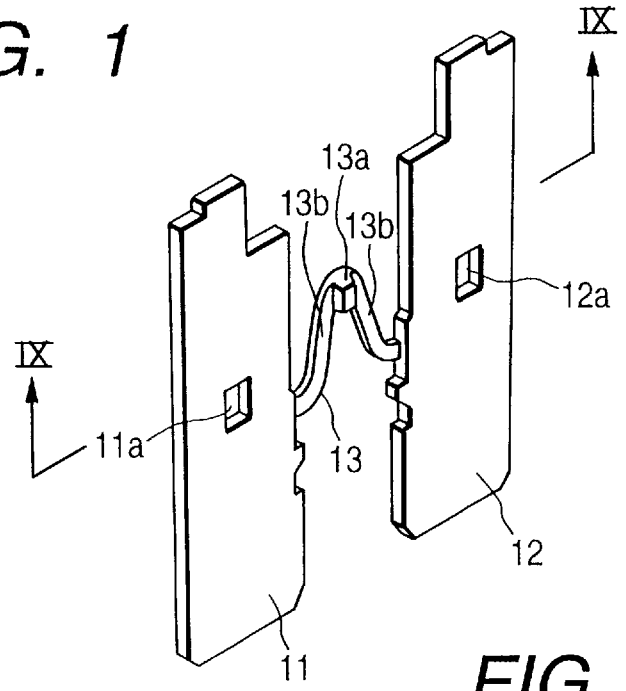
FIG. 1 is a perspective view showing one preferred embodiment of a fuse element of the present invention.

FIG. 1 shows one preferred embodiment of a fuse element of the invention. More specifically, an element 13 is connected between a pair of terminals 11 and 12 integrally therewith, and retaining holes 11*a* and 12*a* are formed respectively through generally central portions of the terminals 11 and 12. When the fuse element is mounted in a housing (not shown), retaining projections, formed on the housing, are engaged in the retaining holes 11*a* and 12*a*, respectively.

Figure 9:
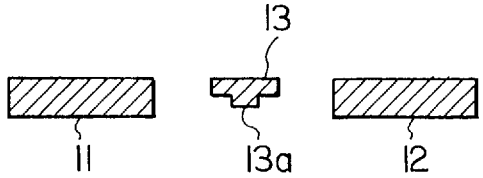
FIG. 9 is a cross-sectional view of the fuse element in FIG. 1.

The terminals 11 and 12 and the element 13 are formed of a suitable material, such as zinc and a zinc alloy, by cutting, or are formed by pressing a profile of such a material. As shown in FIG. 9 thickened portion 13*a* is formed generally at a central portion of the element 13 intermediate opposite ends thereof, and the thickness of the thickened portion 13*a* is larger than the thickness of two thinned portions 13*b* disposed respectively on opposite sides of the thickened portion 13*a*, and is equal to or smaller than the thickness of the terminals 11 and 12.

The thickened portion 13*a*, formed on the element 13, has the function of reducing a fuse resistance and also the function of applying a load to the two thinned portions 13*b* provided respectively on the opposite sides of the thickened portion 13*a*. Because of the reduced fuse resistance, the melting-severing time is increased or prolonged, and because of the application of the load to the thinned portions 13*b*, the severing of the element 13 by melting is promoted. As described above, the fuse element has slow-acting melting-severing characteristics in a small-current range, and has quick-acting melting-severing characteristics in a large-current range.

The function of the thickened portion 13*a* to apply the load to the thinned portions 13*b* is almost ignored in the large-current range in which the quick-acting melting-severing characteristics are exhibited. The reason for this is that the thinned portions 13*b* are severed instantaneously in the large-current range, so that the time period of application of the load to the thinned portions 13*b* is short.

On the other hand, in the small-current range, the slow-acting melting-severing characteristics are exhibited, and therefore the time period of application of the load to the thinned portions 13*b* is long. Therefore, in the small-current range, the fuse resistance is low, and the heating of the element 13 is suppressed, and therefore the melting-severing time is increased; however, the severing of the element 13 by melting is promoted by application of the load to the thinned portions 13*b*. As a result, the melting-severing characteristics are generally the same as obtained where the thickened portion 13*a* is not provided.

By thus forming the thickened portion 13*a* on the element 13, the melting-severing characteristics in the small-current range and the melting-severing characteristics in the large-current range can be controlled independently of each other.

The characteristics of the fuse element of the invention, having the thickened portion formed on the element, will now be described in comparison with the fuse element of the conventional construction.

Figure 2:
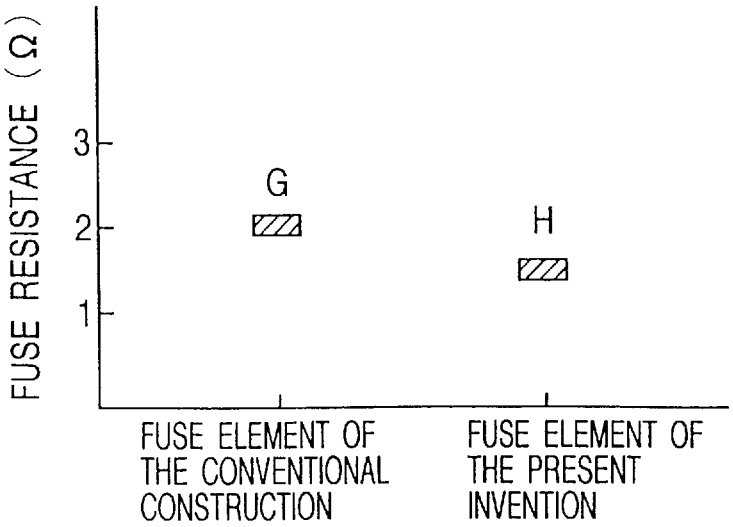
FIG. 2 is a characteristic graph illustrating a fuse resistance of the fuse element.

FIG. 2 shows fuse resistance characteristics of the fuse elements. In FIG. 2, reference character G denotes the fuse resistance characteristics of the fuse element of the conventional construction, and reference character H denotes the fuse resistance characteristics of the fuse element of the invention having the thickened portion. It will be appreciated from FIG. 2 that the formation of the thickened portion on the element reduces the resistance of the fuse element.

Figure 3:
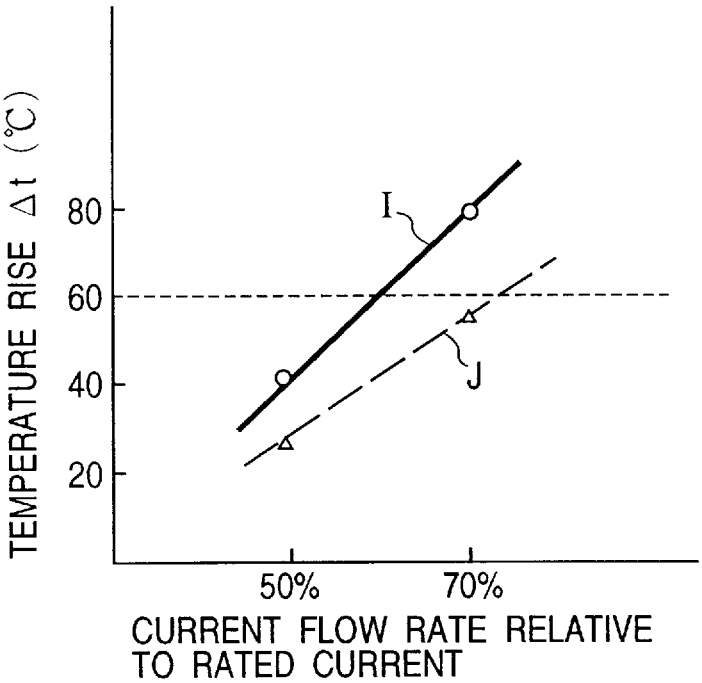
FIG. 3 is a characteristic graph showing the relation between a current flow rate relative to a rated current of the fuse element and a temperature rise.

FIG. 3 shows the relation between a current flow rate relative to a rated current of the fuse element and a temperature rise. In FIG. 3, reference character I denotes characteristics of the fuse element of the conventional construction, and reference character J denotes characteristics of the fuse element of the invention. It will be appreciated from FIG. 3 that by reducing the resistance of the fuse element, the temperature rise can be suppressed, and that the temperature rise can be suppressed more effectively particularly at a high current flow rate.

Figure 4:
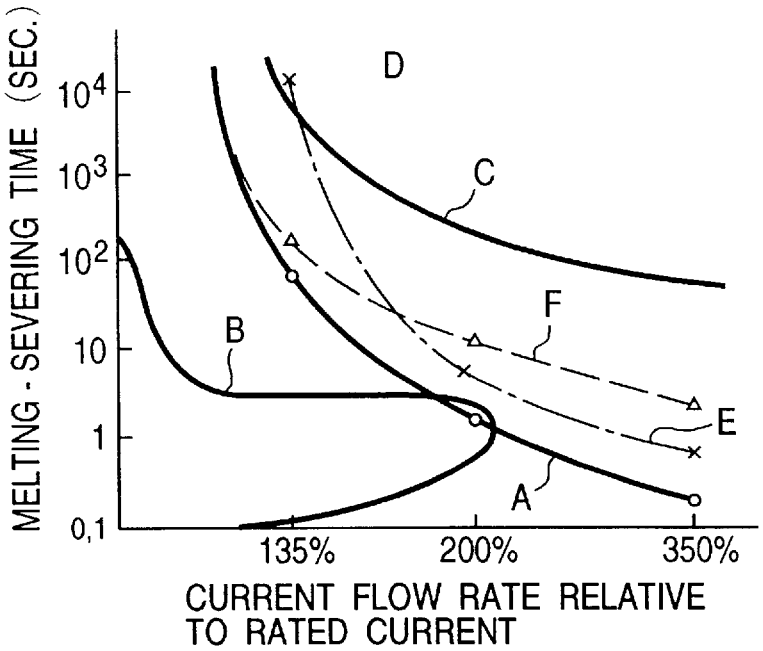
FIG. 4 is a characteristic graph showing the relation between a current flow rate relative to a rated current of the fuse element and a melting-severing time.

FIG. 4 shows the relation between the current flow rate relative to the rated current of the fuse element and the melting-severing time. In FIG. 4, in the relation between the current flow rate relative to the rated current and the melting-severing time shown in FIG. 7, characteristics F of the fuse element of the invention are further shown.

As shown in FIG. 4, the thickened portion is formed to thereby reduce the fuse resistance, and with this construction, in a small-current range represented by the current flow rate of about 135%, the fuse element of the invention have generally the same characteristics as obtained in the fuse element of the conventional construction, so that its characteristic curve does not overlap a dangerous region D of the wire smoke characteristics C, and also in a large-current range represented by the current flow rate of about 200%, the slow-acting melting-severing characteristics are obtained, so that the characteristic curve is out of the range B of the rush current.

In the above embodiment, although the thickened portion 13*a* is formed generally on the central portion of the element 13, a plurality of thickened portions may be formed on the element 13 so as to further reduce the fuse resistance, thereby controlling the melting-severing time.

Figure 8:
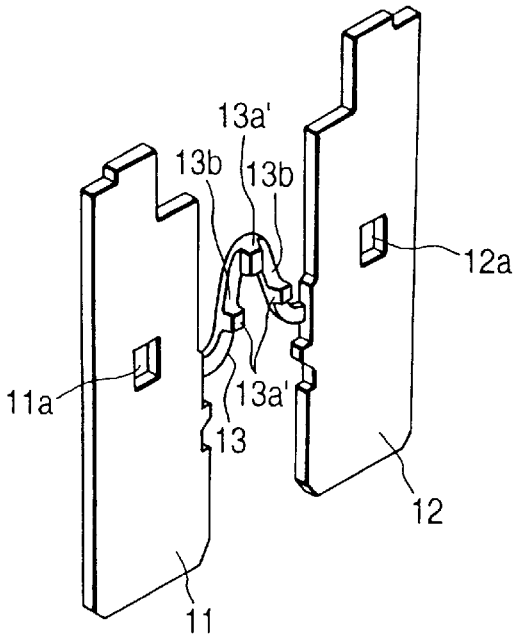
FIG. 8 is a perspective view showing another preferred embodiment of a fuse element of the present invention.

FIG. 8 shows another preferred embodiment of a fuse element of the invention. Although the construction of the fuse element shown in FIG. 8 is substantially same as the fuse element shown in FIG. 1, the fuse element of FIG. 8 includes three thickened portions 13*a*' which are formed generally at a central portion and opposite side portions (disposed respectively on both sides of this central portion) of an element 13, respectively.

Figure 5:
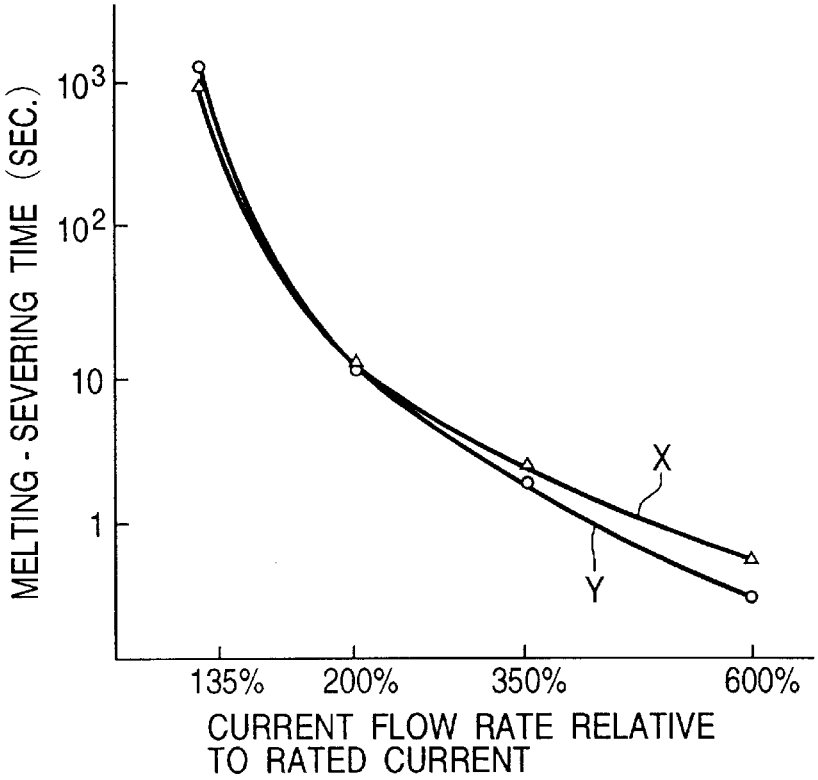
FIG. 5 is a characteristic graph showing the relation between a current flow rate relative to a rated current of the fuse element and a melting-severing time.

FIG. 5 shows melting-severing characteristics of the fuse element of FIG. 8 in which the three thickened portions 13*a*' are formed respectively on the central portion and the opposite side portions of the element 13. As shown in FIG. 5, with the melting-severing characteristics X of the element 13 having the three thickened portions 13*a*', the melting-severing time is longer as compared with the melting-severing characteristics Y of the element 13 having one thickened portion 13*a*. On the other hand, in a small-current range, the severing of the element by melting is promoted as a result of provision of the thickened portions 13*a*' which apply the load to thinned portions 13*b*, and therefore the melting-severing time will not be increased.

Furthermore, for example, the fuse element in FIG. 1 is modified so that the position of a thickened portion 13*a* is offset right or left from a central portion of an element 3, thereby changing the center of gravity of the element 13. With this arrangement, a stress, acting on one of two thinned portions 13*b* (which are disposed respectively on opposite sides of the thickened portion 13*a*) is different in amount from a stress acting on the other thinned portion 13*b*, and therefore the severing (by melting) of that thinned portion 13*b* subjected to a larger load is promoted.

As described above, the fuse element of the present invention includes the pair of terminals, the fusible element interconnecting the pair of terminals, and at least one load portion is formed on the fusible element, the fusible element and the load portion being made of the same material. With this construction, the melting-severing characteristics in the small-current range and the melting-severing characteristics in the large-current range can be controlled independently of each other. As a result, the durability against the rush current can be enhanced, and also the temperature rise of the fusible element can be suppressed.

The load portion is defined by the thickened portion formed integrally with the fusible element, and the thickness of the thickened portion is larger than the thickness of the fusible element, and is equal to or smaller than the thickness of the terminals. Therefore, the load portion is provided without the need for using a separate member, and the terminals, the fusible element and the thickened portion can be formed into an integral construction.

What is claimed is:

1. A blade-type fuse element for high-density mounting, comprising:

a fusible element;

a pair of terminals connected together through said fusible element, wherein said terminals are arranged in parallel for insertion in a housing; and at least one load portion formed on said fusible element, wherein said fusible element and said load portion are made of the same material.

2. The blade-type fuse element of claim 1, wherein said load portion is formed on said fusible element to reduce a fuse resistance and to apply a load to said fusible element.

3. The blade-type fuse element of claim 1, wherein a position of said load portion on said fusible element is set in accordance with a desired characteristic of the fuse element.

4. The blade-type fuse element recited in claim 1, wherein said pair of terminals have retaining holes formed therein for retaining said terminals in a housing.

5. The blade-type fuse element recited in claim 1, wherein said fusible element has a curved portion and said load portion is positioned on said curved portion.

6. A blade-type fuse element, comprising:

a fusible element;

a pair of terminals connected together through said fusible element; and at least one load portion formed on said fusible element, wherein said fusible element and said load portion are made of the same material, wherein said load portion is defined by a thickened portion formed integrally with said fusible element, and a thickness of said thickened portion is larger than a thickness of said fusible element, and is not larger than a thickness of each of said terminals.

7. A blade-type fuse element, comprising:

a fusible element;

a pair of terminals connected together through said fusible element; and at least one load portion formed on said fusible element, wherein said fusible element and said load portion are made of the same material, wherein said fusible element has three load portions.

8. The blade-type fuse element of claim 7, wherein said three load portions are formed substantially at a central portion of said fusible element and opposite side portions of said fusible element disposed on both sides of the central portion, respectively, so that said fusible element has four sections.

9. A blade-type fuse element, comprising:

a fusible element;

a pair of terminals connected together through said fusible element; and at least one load portion formed on said fusible element, wherein said fusible element and said load portion are made of the same material, wherein a length of said load portion is substantially less than a length of said fusible element which is not formed into said load portion.

* * * * *